US007147063B2

(12) United States Patent
Chen

(10) Patent No.: US 7,147,063 B2
(45) Date of Patent: Dec. 12, 2006

(54) DOUBLE-RAM STRIKER ASSEMBLY

(75) Inventor: Hsin-Chi Chen, Taiping (TW)

(73) Assignee: Tranmax Machinery Co., Ltd., Taiping (TW)

( * ) Notice: Subject to any disclaimer, the term of this patent is extended or adjusted under 35 U.S.C. 154(b) by 61 days.

(21) Appl. No.: 11/118,435

(22) Filed: May 2, 2005

(65) Prior Publication Data

US 2006/0157261 A1 Jul. 20, 2006

(30) Foreign Application Priority Data

Jan. 18, 2005 (TW) ..... 94200921 U

(51) Int. Cl.
*B25D 15/00* (2006.01)

(52) U.S. Cl. ..... 173/93.5; 173/93; 173/93.6

(58) Field of Classification Search ..... 173/93, 173/93.5, 93.6, 104, 109; 81/465, 466
See application file for complete search history.

(56) References Cited

U.S. PATENT DOCUMENTS 2,663,395 A * 12/1953 Schmid ..... 173/93.5
3,661,217 A * 5/1972 Maurer ..... 173/93.5
4,287,956 A * 9/1981 Maurer ..... 173/93.5
6,070,674 A * 6/2000 Williamson et al. ..... 173/1
6,491,111 B1 * 12/2002 Livingston et al. ..... 173/93.5
6,889,778 B1 * 5/2005 Colangelo et al. ..... 173/93.5

* cited by examiner

*Primary Examiner*—Scott A. Smith
(74) *Attorney, Agent, or Firm*—Lowe Hauptman & Berner, LLP

(57) ABSTRACT

A double-ram striker assembly including a shaft anvil having a shaft body on which two jaw blocks are disposed and two ring-shaped ram bodies coaxially fitted on the shaft body. The inner circumferences of the ram bodies serve to respectively ram lateral faces of the corresponding jaw blocks. A predetermined gap is defined between opposite end faces of the two ram bodies along the axis of the shaft body. The striker assembly further includes at least three rolling sections arranged in the gas. Two opposite ends of each rolling section respectively abut against the opposite end faces of the two ram bodies.

8 Claims, 4 Drawing Sheets

10

10

10

DOUBLE-RAM STRIKER ASSEMBLY

BACKGROUND OF THE INVENTION

The present invention is related to a pneumatic tool, and more particularly to an improved double-ram striker assembly.

The double-ram striker assembly of the conventional pneumatic tool is composed of two ring-shaped ram bodies and a shaft anvil. The ram bodies are coaxially fitted on the shaft anvil. Two opposite end faces of the ram bodies attach to each other. The ram bodies alternately circularly respectively ram the jaw blocks formed on the shaft anvil. Accordingly, a torque is output through the shaft anvil. When the ram bodies are moved relative to each other for ramming the jaw blocks, the end faces of the ram bodies will abrade each other at high speed. As a result, the loss of power is increased and the wear of the components is speeded to shorten using life of the striker assembly.

U.S. Pat. No. 6,491,111 discloses a striker assembly in which the edges of the two separated jaw blocks are connected with a ring. Therefore, the weaker edges of the jaw blocks are reinforced. When rammed, the jaw blocks have better strength to avoid damage. However, the above shortcomings existing in the prior art still can be hardly eliminated.

SUMMARY OF THE INVENTION

It is therefore a primary object of the present invention to provide an improved double-ram striker assembly in which the friction between the ram bodies can be greatly reduced so that the relative movement between the ram bodies is smoothened. The ramming force is evenly distributed over the shaft anvil so that the using life of the striker assembly can be prolonged.

It is a further object of the present invention to provide the above double-ram striker assembly in which when the ram bodies ram the jaw blocks, the ram bodies will not directly touch the weaker edges of the jaw blocks so that the damage of the weaker sections of the jaw blocks can be avoided so as to prolong using life of the components.

According to the above objects, the double-ram striker assembly of the present invention includes a shaft anvil having a shaft body on which two jaw blocks are disposed and two ring-shaped ram bodies coaxially fitted on the shaft body. The inner circumferences of the ram bodies serve to respectively ram lateral faces of the corresponding jaw blocks. A predetermined gap is defined between opposite end faces of the two ram bodies along the axis of the shaft body. The striker assembly further includes at least three rolling sections arranged in the gas. Two opposite ends of each rolling section respectively abut against the opposite end faces of the two ram bodies.

The present invention can be best understood through the following description and accompanying drawings wherein:

DETAILED DESCRIPTION OF THE PREFERRED EMBODIMENTS

Figure 1:
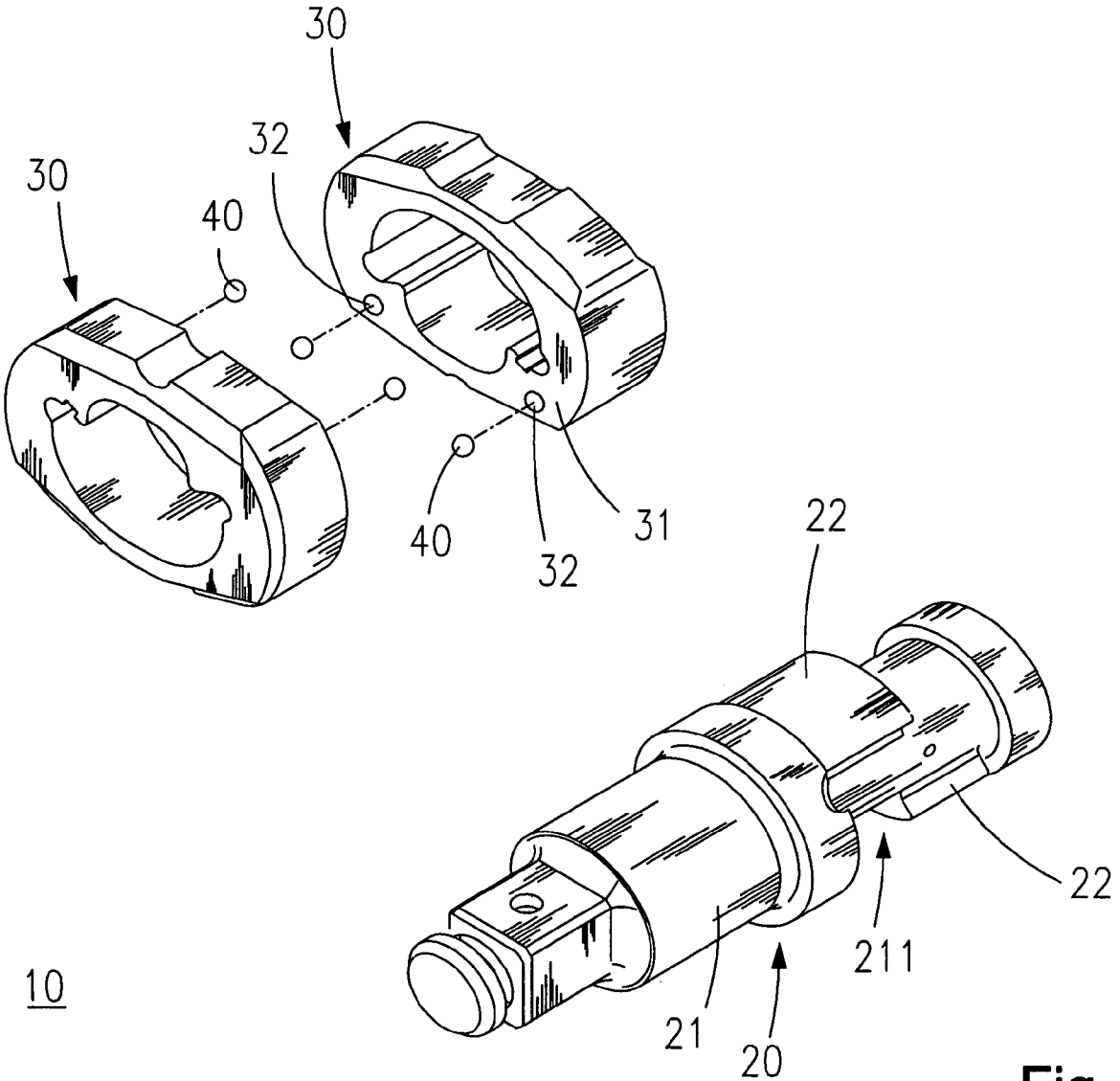
FIG. 1 is a perspective exploded view of a preferred embodiment of the present invention.
Figure 2:
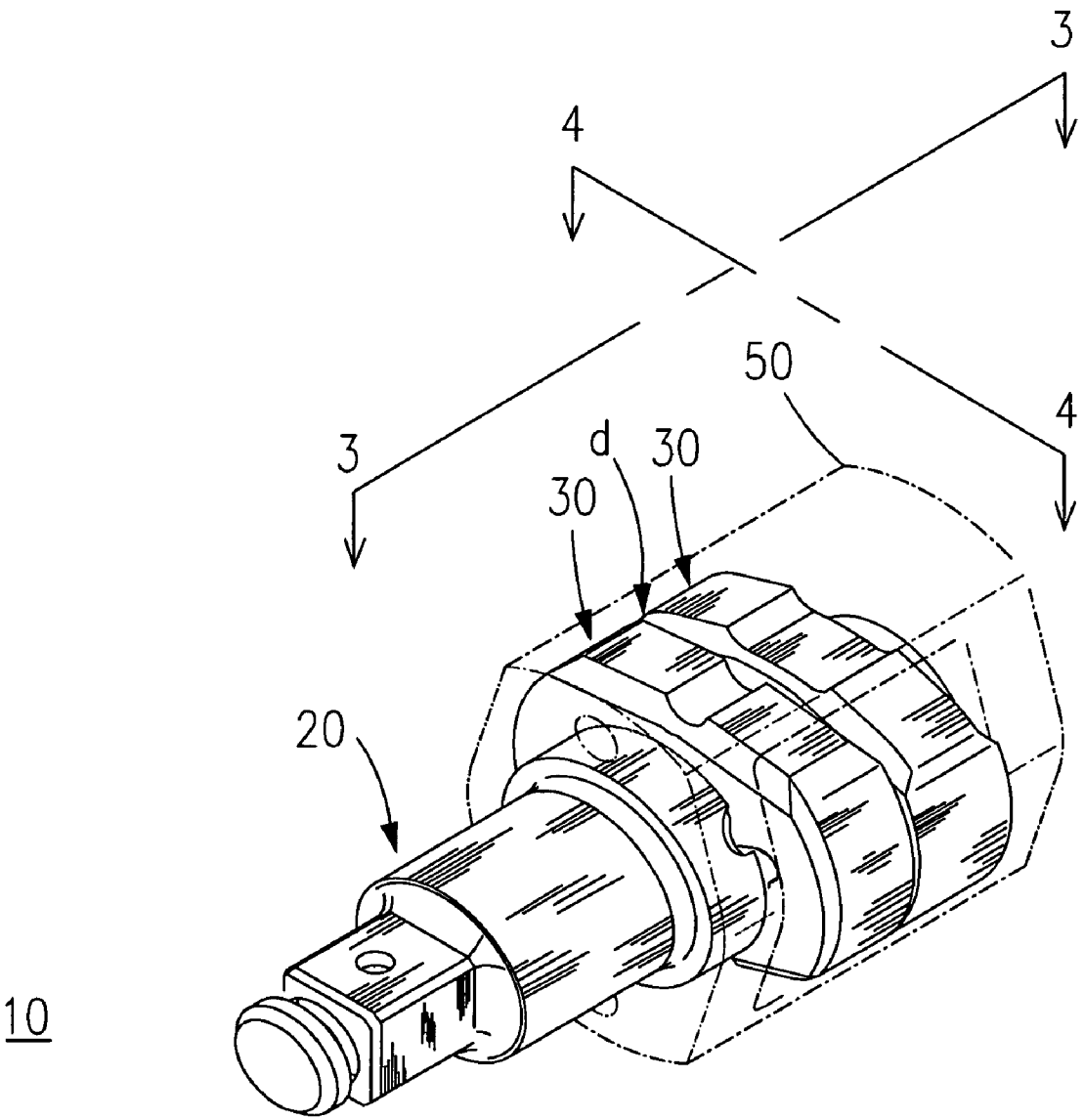
FIG. 2 is a perspective assembled view of the embodiment of the present invention.
Figure 3:
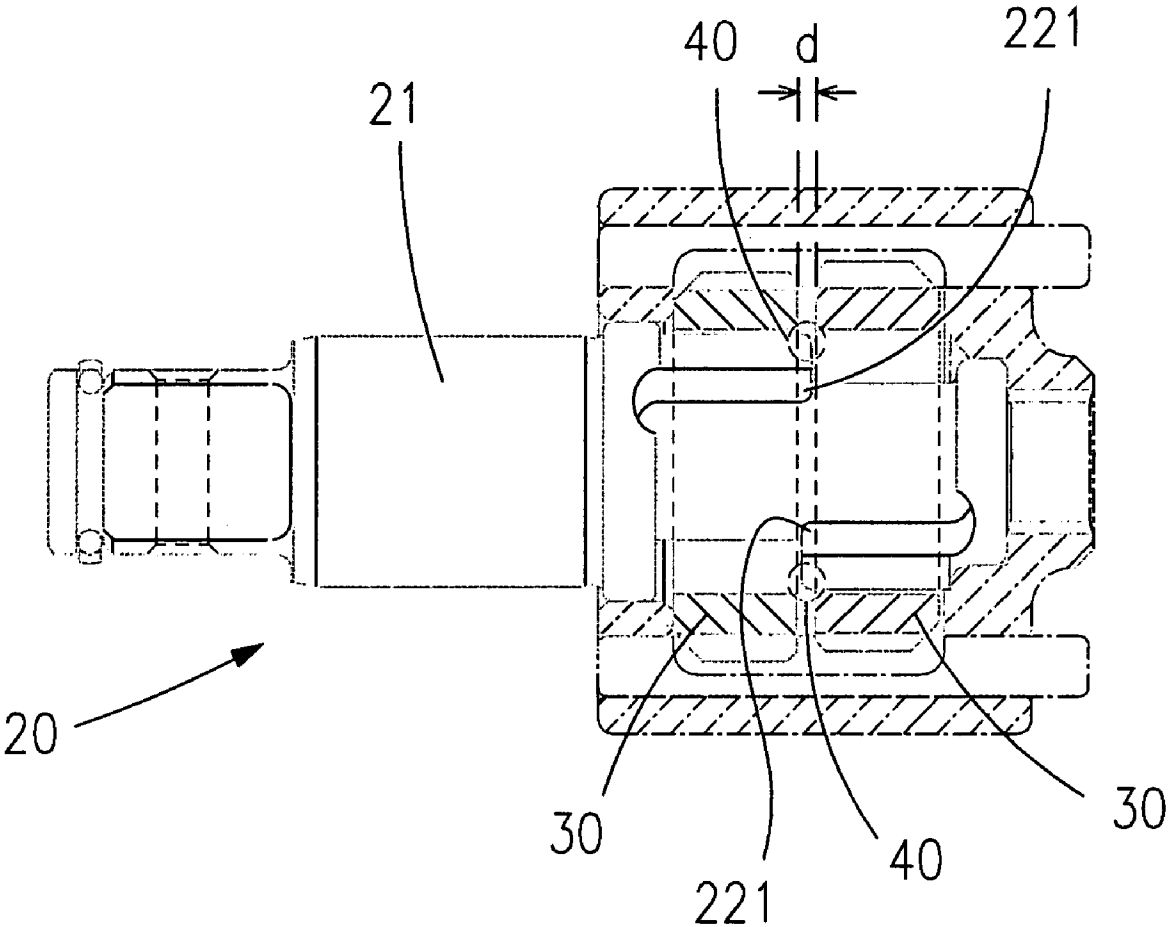
FIG. 3 is a sectional view taken along line 3—3 of FIG. 2.
Figure 5:
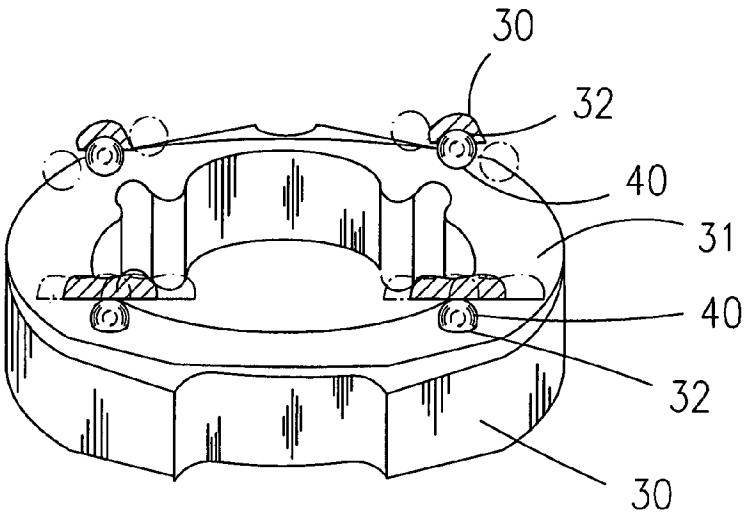
FIG. 5 is a perspective view showing the rolling sections and the ram body of the present invention.
Figure 4:
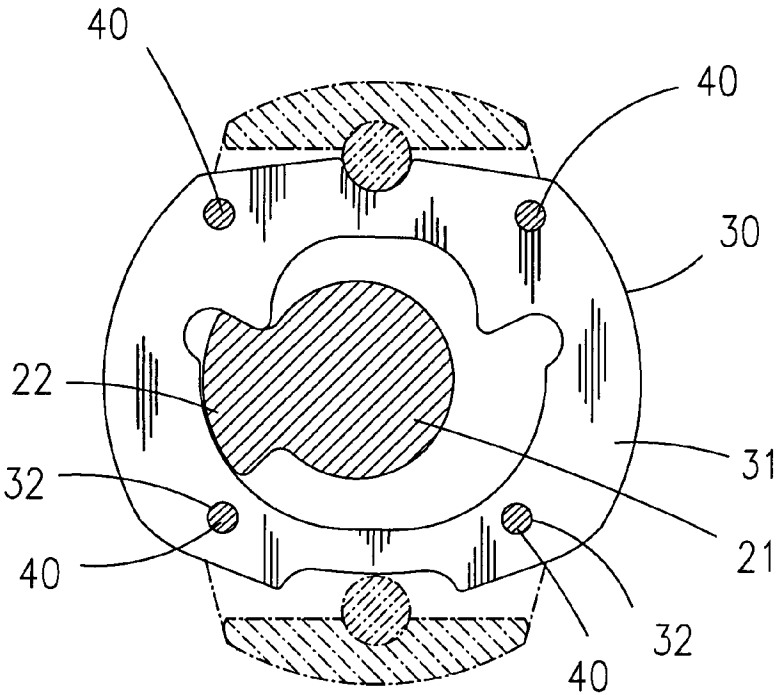
FIG. 4 is a sectional view taken along line 4—4 of FIG. 2.

Please refer to FIGS. 1 to 5. The double-ram striker assembly 10 of the present invention includes a shaft anvil 20, two ram bodies 30 and two rolling sections 40.

The shaft anvil 20 has a shaft body 21 having a ramming section 211 with a smaller outer diameter. Two elongated jaw blocks 22 respectively protrude from the ramming section 211 of the shaft body 21 at angular intervals of 180 degrees. The axis of the jaw blocks 22 is parallel to the axis of the shaft body 21. The opposite ends of the two jaw blocks 22 have overlapping sections 221 along the axis of the shaft body 21.

The ram bodies 30 have a configuration basically identical to the prior art. The ram bodies 30 are fitted around the ramming section 211. The inner circumferences of the ram bodies 30 serve to ram lateral faces of the jaw blocks 22 so as to output a certain torque through the shaft anvil 20. The operation of the ram bodies 30 and the shaft anvil 20 is identical to that of the prior art and thus will not be further described hereinafter. The present invention is characterized in that a gap d is defined between the opposite end faces 31 of the two ram bodies 30 along the axis of the shaft body 20. The gap d corresponds to the overlapping sections 221 of the jaw blocks. In addition, the opposite end faces 31 of the ram bodies are respectively formed with two pairs of locating dents 32 with a certain depth. The two pairs of locating dents 32 are evenly distributed over the opposite end faces 31 of the ram bodies 30. To speak more specifically, in this embodiment, the two pairs of locating dents 32 are arranged along the short axis of the elliptic configuration of the ram bodies 30.

The two pairs of rolling sections 40 are steel balls with a certain outer diameter. The rolling sections 40 are respectively partially accommodated in the corresponding locating dents 32. In addition, the size of the part of the steel ball protruding from the end face 31 is equal to the size of the gap d, whereby the steel balls abut against the opposite end face of the other ram body.

External high-pressure air is used to drive a pneumatic cylinder which further drives a casing 50. The casing 50 drives the ram bodies 30 to rotate and sequentially circularly strike the corresponding jaw blocks 22. When struck, the ram bodies 30 are moved relative to each other. At this time, by means of the gap d, the end faces of the ram bodies are prevented from directly contacting with each other. Therefore, the power loss and wear of components caused by the slide friction can be avoided. Moreover, the rolling sections 40 can keep the gap d defined between the ram bodies 30 and roll between the ram bodies 30. Accordingly, the ram bodies 30 can be moved relative to each other under rolling friction. Therefore, the wear is reduced and the using life of the components can be prolonged.

Furthermore, in this embodiment, the overlapping sections 221 of the opposite ends of the jaw blocks 22 correspond to the gap d. This means that the overlapping sections 221 of the jaw blocks will not be directly struck by the ram bodies. Accordingly, the weaker edges of the jaw blocks 22, that is, the overlapping sections 221 will not be directly rammed by the ram bodies 30 so as to avoid damage of the edges. In addition, by means of such structure, the total area of the jaw blocks 22 to which the ramming force is applied is enlarged. Therefore, the force can be evenly exerted onto the shaft anvil 20 to prolong the using life of the structure.

The above embodiments are only used to illustrate the present invention, not intended to limit the scope thereof. Many modifications of the above embodiments can be made without departing from the spirit of the present invention.

What is claimed is:

1. A double-ram striker assembly comprising:

a shaft anvil having a shaft body on which two jaw blocks are disposed; and two ring-shaped ram bodies coaxially fitted on the shaft body, inner circumferences of the ram bodies serving to respectively ram lateral faces of the corresponding jaw blocks, said striker assembly being characterized in that a predetermined gap is defined between opposite end faces of the two ram bodies along the axis of the shaft body, said striker assembly being also characterized in that the striker assembly further comprising at least three rolling sections arranged in the gap, two opposite ends of each rolling section respectively abutting against the opposite end faces of the two ram bodies.

2. The double-ram striker assembly as claimed in claim 1, wherein there are two pairs of rolling sections.

3. The double-ram striker assembly as claimed in claim 2, wherein the opposite end faces of the ram bodies are respectively formed with two pairs of locating dents with a predetermined depth, the two pairs of rolling sections being respectively accommodated in the locating dents.

4. The double-ram striker assembly as claimed in claim 3, wherein each rolling section has an outer diameter which is the sum of the depth of the locating dent and the gap.

5. The double-ram striker assembly as claimed in claim 1, wherein the rolling sections are steel balls.

6. A double-ram striker assembly comprising:

a shaft anvil having a shaft body, the shaft body having a ramming section, two elongated jaw blocks respectively protruding from the ramming section of the shaft body at angular intervals of 180 degrees, the jaw blocks being respectively positioned at two ends of the ramming section, an axis of the jaw blocks being parallel to an axis of the shaft body; and two ring-shaped ram bodies fitted on the shaft body, inner circumferences of the ram bodies serving to respectively ram lateral faces of the corresponding jaw blocks, said striker assembly being characterized in that a predetermined gap is defined between opposite end faces of the two ram bodies along the axis of the shaft body, an impacting end of each jaw block extending into the gap.

7. The double-ram striker assembly as claimed in claim 6, further comprising several rolling sections sandwiched between the opposite end faces of the two ram bodies.

8. The double-ram striker assembly as claimed in claim 7, wherein each rolling section has an outer diameter larger than the gap, one side of each rolling section being accommodated in a locating dent of the end face of the ram body, the size of the portion of the rolling section protruding from the end face being equal to the size of the gap.

* * * * *